US006806763B2

(12) United States Patent
Kim et al.

(10) Patent No.: US 6,806,763 B2
(45) Date of Patent: Oct. 19, 2004

(54) PROGRAMMABLE REFERENCE VOLTAGE GENERATING CIRCUIT

(75) Inventors: Nam-Seog Kim, Seoul (KR); Jin-Ho Lee, Seoul (KR)

(73) Assignee: Samsung Electronics Co., Ltd. (KR)

( * ) Notice: Subject to any disclaimer, the term of this patent is extended or adjusted under 35 U.S.C. 154(b) by 74 days.

(21) Appl. No.: 10/059,676

(22) Filed: Jan. 30, 2002

(65) Prior Publication Data

US 2003/0001661 A1 Jan. 2, 2003

(30) Foreign Application Priority Data

Jun. 27, 2001 (KR) ..... 2001-36883

(51) Int. Cl.[7] ..... G05F 1/10; G05F 3/02
(52) U.S. Cl. ..... 327/541; 327/543
(58) Field of Search ..... 327/530, 538, 327/540, 541, 543

(56) References Cited

U.S. PATENT DOCUMENTS 6,185,139 B1 * 2/2001 Pantelakis et al. ..... 365/201
6,288,563 B1 * 9/2001 Muljono et al. ..... 326/27

* cited by examiner

*Primary Examiner*—Quan Tra
(74) *Attorney, Agent, or Firm*—F. Chau & Associates LLC

(57) ABSTRACT

A reference voltage generating circuit includes a binary-to-thermometer for converting binary codes into thermometer codes; an internal reference voltage generator for generating an internal reference voltage in response to the thermometer codes from the binary-to-thermometer, wherein the internal reference voltage generator changes a level of the internal reference voltage in response to the thermometer codes; a selector for selecting the internal reference voltage or an external reference voltage in response to a reference voltage select signal; and a voltage regulator for regulating a reference voltage selected by the selector.

5 Claims, 6 Drawing Sheets

PROGRAMMABLE REFERENCE VOLTAGE GENERATING CIRCUIT

BACKGROUND OF THE INVENTION

1. Field of the Invention

The present invention relates to a device for generating a reference voltage, and more particularly to a reference voltage generating circuit for generating a reference voltage which is controllable with programmable codes.

2. Description of the Related Art

Generally, a reference voltage is used in a logic circuit as a threshold voltage for determining logic levels of data. As shown in FIG. 1, when a reference voltage Vref is used as the threshold voltage to determine levels of data, the data is determined to have a logic "low level" if the data is lower than the reference voltage Vref and to have a logic "high level" if the data is higher than the reference voltage Vref.

FIG. 2 shows a system board 200 in which a reference voltage Vref is supplied to multiple chips. The reference voltage Vref is generated from a reference voltage generating circuit 202 and supplied to the respective chips 210, 212, 214, . . . n. In this case, the level of the reference voltage Vref may vary with the difference in physical distance between the reference voltage generating circuit 202 and the respective chips 210, 212, 214, . . . n. As shown in FIG. 2, the first chip 210 is positioned near the reference voltage generating circuit 202, so that a reference voltage supplied to the first chip 210 has level "A" which is substantially equal to the level of the reference voltage Vref generated from the reference voltage generating circuit 202. Since the second chip 212 is positioned relatively far from the reference voltage generating circuit 202, a reference voltage supplied to the second chip 212 has level "B" which is slightly lower than the level of the reference voltage Vref. Since the third chip 214 is positioned relatively farther from the reference voltage generating circuit 202 than the first and second chips 210, 212, a reference voltage supplied to the third chip 214 has level "C" and is even lower than the level of the reference voltage Vref.

In such an environment, the reference voltages supplied to the respective chips 210, 212, 214 are different from each other, and the threshold voltage for determining logic levels of data varies in different chips. As a result, in the third chip 214 receiving the reference voltage with level "C", there is a problem in that data is determined to be logic "high" in regions "E1" and "E2", which would have been determined as logic "low".

As speed of data interface between the chips is increased, swing width of external signals as well as data is needed to be smaller. Thus, in high speed data interface circumstances, noise of a reference voltage supplied from an external may affect the determination of logic levels (e.g., VIL, VIH) of input signals.

Accordingly, a need exists for a system which provides a reference voltage having a stable level to the chips where the reference voltage is used for determining logic levels of input data.

SUMMARY OF THE INVENTION

It is an object of the present invention to provide a reference voltage generating circuit for generating a programmable reference voltage in response to an external code.

Another object of the present invention is to provide a method of arranging the reference voltage generating circuit.

To accomplish the above and other objects of the present invention, a reference voltage generating circuit comprises a binary-to-thermometer for converting binary codes into thermometer codes; an internal reference voltage generator for generating an internal reference voltage in response to the thermometer codes from the binary-to-thermometer, wherein the internal reference voltage generator changes a level of the internal reference voltage in response to the thermometer codes; a selector for selecting the internal reference voltage or an external reference voltage in response to a reference voltage select signal; and a voltage regulator for regulating a reference voltage selected by the selector.

The binary-to-thermometer comprises thermometer code generators for generating the thermometer codes in response to the binary codes. The thermometer code generators each include a logic gate for selectively inputting the binary codes, transmission gates for transmitting an output of the logic gate to generate a thermometer code in response to a selected signal (e.g., the MSB) of the binary codes, and transistors for resetting the thermometer code in response to the selected signal (e.g., the MSB) of the binary codes.

The internal reference voltage generator includes a reference voltage bias part having a diode type first transistor connected between a power source voltage and the internal reference voltage and a diode type second transistor connected between the internal reference voltage and ground voltage, and a reference voltage coding part for increasing or decreasing the internal reference voltage in response to the thermometer codes.

The reference voltage coding part includes voltage-up controllers connected between the power source voltage and the internal reference voltage, for increasing the internal reference voltage in response to the thermometer codes, and voltage-down controllers connected between the internal reference voltage and the ground voltage, for decreasing the internal reference voltage in response the thermometer codes.

The voltage-up controllers each include inverter type first and second transistors connected between the power source voltage and the internal reference voltage and controlled by the thermometer codes, and a third transistor connected between the power source voltage and the internal reference voltage, for increasing the internal reference voltage in response to outputs of the first and second transistors. The voltage-down controllers each include inverter type fourth and fifth transistors connected between the internal reference voltage and the ground voltage and controlled by the thermometer codes, and a sixth transistor connected between the internal reference voltage and the ground voltage for decreasing the internal reference voltage in response to outputs of the fourth and fifth transistors.

To accomplish another object, a method of arranging reference voltage generating circuits in a chip, comprises the steps of arranging in the chip devices sharing a reference voltage generated from the reference voltage generating circuits; and arranging the reference voltage generating circuit at the end sides of the chip, wherein the devices are connected in common with the reference voltage generating circuits. The step of arranging the reference voltage generating circuits includes arranging one reference voltage generating circuit at one end side of the chip; and arranging the other reference voltage generating circuit at the other end side of the chip, wherein the two end sides are opposite to each other.

According to the present invention as described above, there is an advantage that a reference voltage is controlled using programmable codes. In addition, reference voltage generating circuits may be disposed at predetermined positions (e.g., the end sides opposite to each other) of a chip having devices receiving and sharing a reference voltage, thereby reducing the chip size and to prevent occurrence of errors due to a mismatch between the reference voltage generating circuits.

BRIEF DESCRIPTION OF THE DRAWINGS

These and other objects, features and advantages of the invention will become more apparent from the following detailed description of preferred embodiments of the present invention made with reference to the accompanying drawings, of which.

DETAILED DESCRIPTION OF PREFERRED EMBODIMENTS

Figure 1:
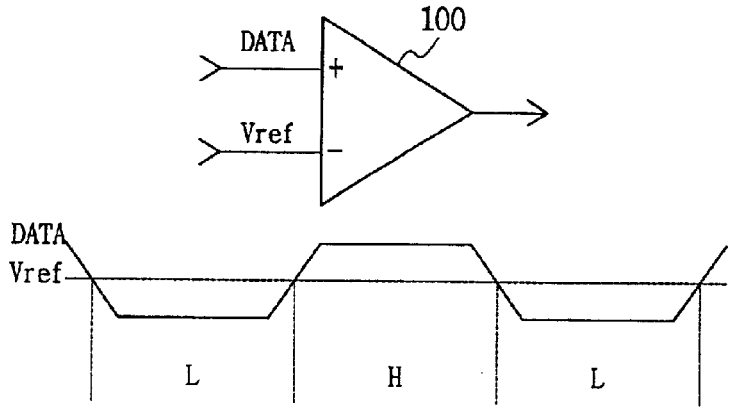
FIG. 1(PRIOR ART)
FIG. 1 is a diagram for illustrating typical usage of a reference voltage in a logic circuit.
Figure 2:
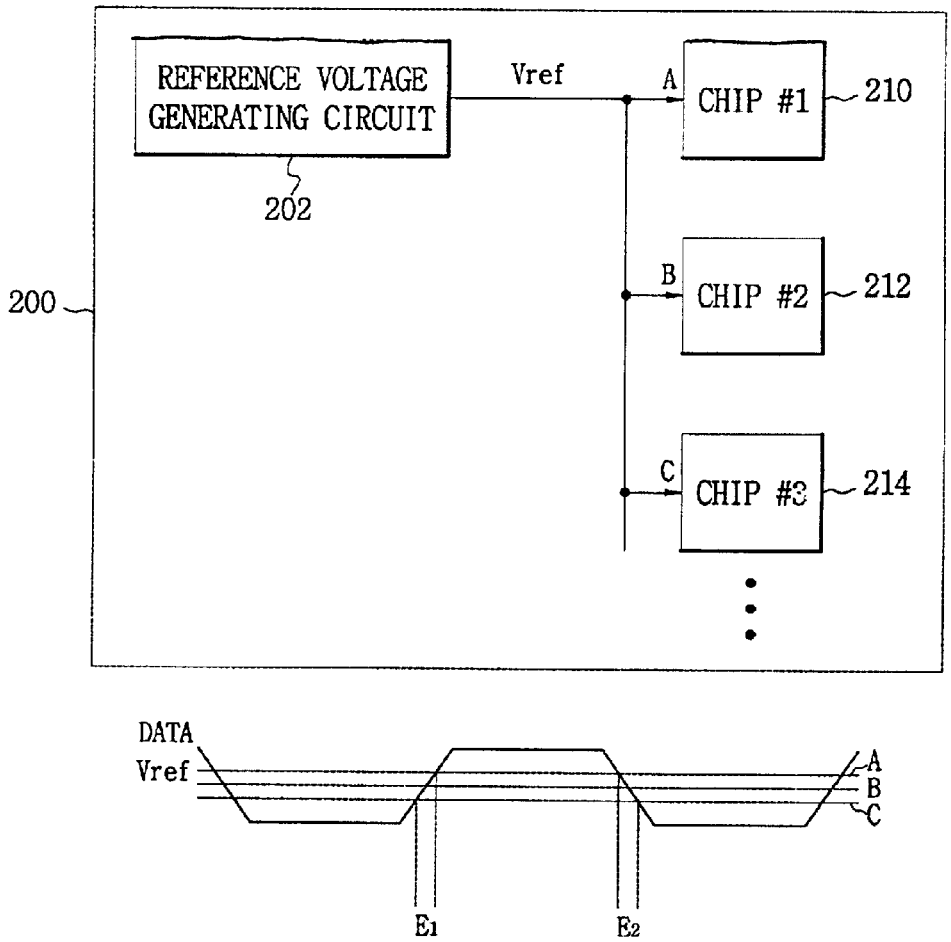
FIG. 2(PRIOR ART)
FIG. 2 is a diagram for illustrating typical configuration of a reference voltage generating circuit and chips connected thereto.

Hereinafter, preferred embodiments of the present invention will be explained with reference to the accompanying drawings. Like reference numerals indicate like elements in the drawings.

Figure 3:
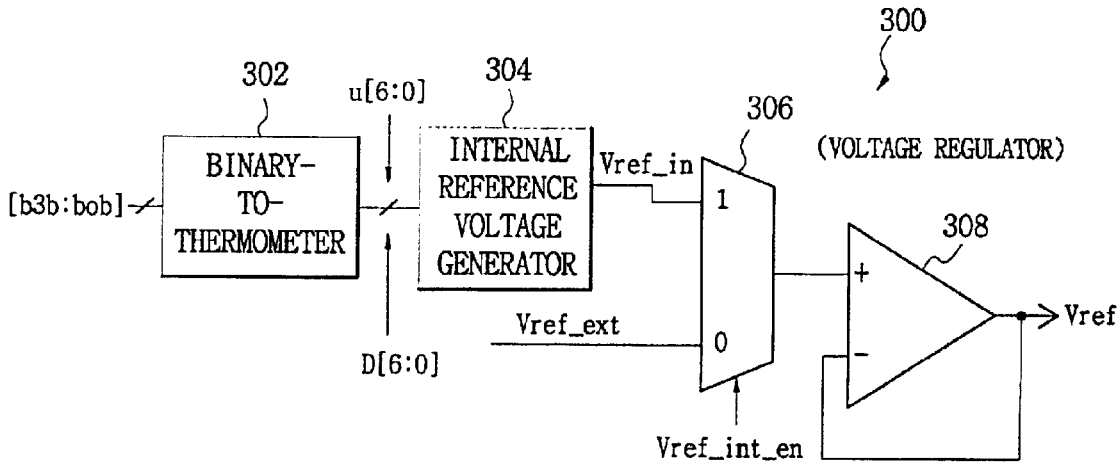
FIG. 3 is a block diagram for illustrating a reference voltage generating circuit according to an embodiment of the present invention.

FIG. 3 is a block diagram of a reference voltage generating circuit according to an embodiment of the present invention. A reference voltage generating circuit 300 comprises a binary-to-thermometer 302, an internal reference voltage generator 304, a selector 306, and a voltage regulator 308.

The binary-to-thermometer 302 serves to convert binary codes [b3b:b0b] externally supplied into thermometer codes U[6:0], D[6:0]. The internal reference voltage generator 304 generates an internal reference voltage Vref_in in response to the thermometer codes U[6:0], D[6:0]. The selector 306 selects one of the internal reference voltage Vref_in and an external reference voltage Vref_ext in response to a reference voltage select signal Vref_int_en. The voltage regulator 308 receives a reference voltage selected by the selector 306 and feeds the output signal back to another input of the voltage regulator 308, thereby generating a desirable reference voltage Vref.

Figure 4:
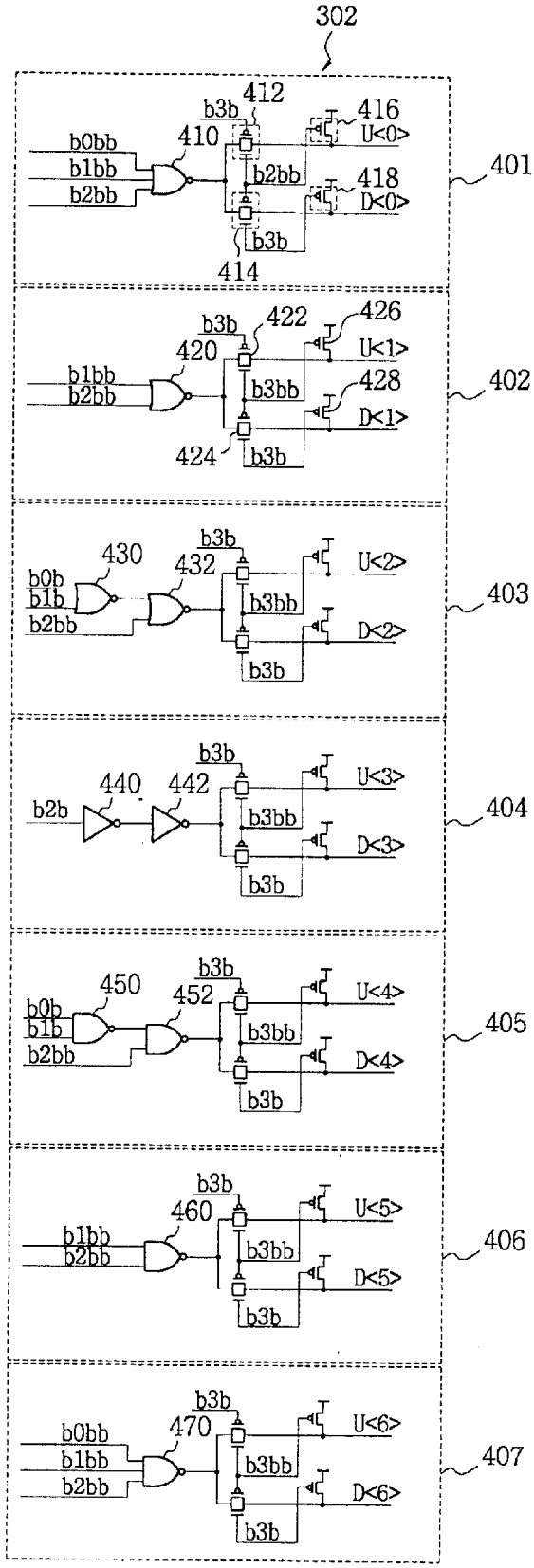
FIG. 4 is a circuit diagram for illustrating the binary-to-thermometer shown in FIG. 3.

Referring to FIG. 4, there is provided a circuit diagram of a binary-to-thermometer according to a preferred embodiment of the present invention. The binary-to-thermometer 302 generates the thermometer codes U[6:0], D[6:0] using input binary codes [b3b:b0bb] and their combination. The binary-to-thermometer 302 includes transistors having switching functions, and the thermometer codes U[6:0], D[6:0] may be obtained by employing certain combinations of the transistors in the binary-to-thermometer 302.

For example, the binary-to-thermometer 302 in FIG. 4 comprises seven thermometer code generators 401–407. The first thermometer code generator 401 includes a 3-input NOR gate 410 receiving binary signals b0bb, b1bb, b2bb, first and all second transmission gates 412, 414 for transmitting an output of the 3-input NOR gate U.! 410 in response to binary codes b3b, b3bb to generate first thermometer codes U<0>, D<0>. The first thermometer code generator 401 may also include transistors 416, 418 for resetting the first thermometer codes U<0>, D<0> in response to the binary codes b3bb, b3b.

The second thermometer code generator 402 includes a 2-input NOR gate 420 receiving binary codes b1bb, b2bb. The second thermometer code generator 402 also includes transmission gates 422, 424 for transmitting an output of the 2-input NOR gate 420 in response to binary codes b3b, b3bb to generate second thermometer codes U<1>, D<1> and reset transistors 426, 428 for resetting the second thermometer codes U<1>, D<l>.

The third thermometer code generator 403 includes a first 2-input NOR gate 430 receiving binary codes b0b, b1b and a second 2-input NOR gate 432 receiving an output of the first 2-input NOR gate 430 and binary code b2bb. The fourth thermometer code generator 404 includes inverters 440, 442 that are connected to each other in series and receive binary code b2b. The fifth thermometer code generator 405 includes a first 2-input NAND gate 450 receiving binary codes b0b, b1b and a second 2-input NAND gate 452 receiving an output of the first 2-input NAND gate 450 and binary code b2bb. The sixth thermometer code generator 406 includes a 2-input NAND gate 460 receiving binary codes b1bb, b2bb, and the seventh thermometer code generator 407 includes a 3-input NAND gate 470 receiving binary codes b0bb, b1bb, b2bb. The third through seventh thermometer code generators 403–407 each also include transmission gates and reset transistors which have the substantially same functions and configuration as those in the first and second thermometer code generators 401, 402. Thus, a detailed description of the transmission gates and the reset transistors in the third through seventh thermometer code generators 403—407 is omitted.

The first to seventh thermometer codes U[6:0], D[6:0] generated from the first to seventh thermometer code generators 401 to 407, respectively, are supplied to the internal reference voltage generator 304 (referring to FIG. 3).

Figure 5:
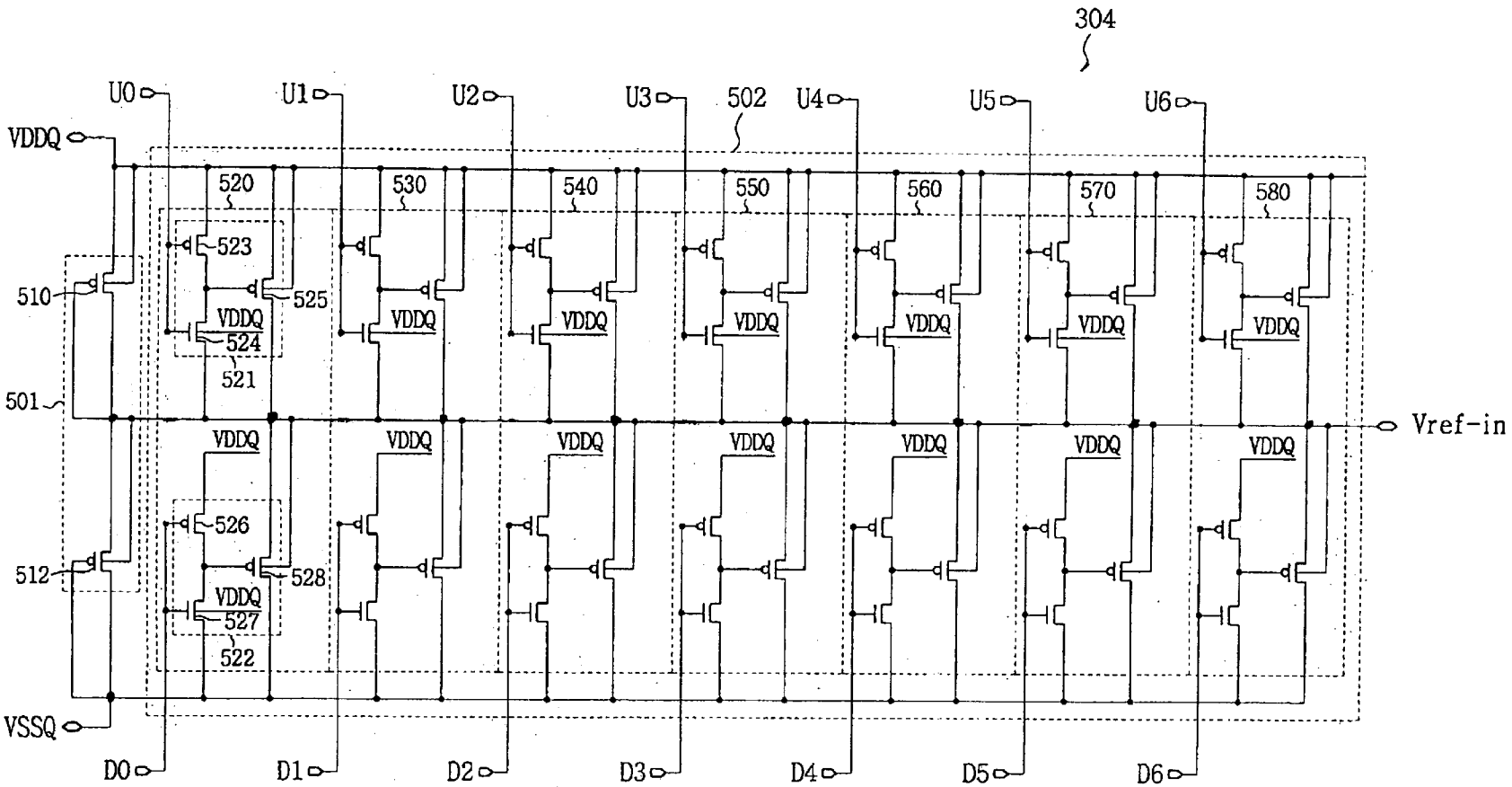
FIG. 5 is a circuit diagram for illustrating the internal reference voltage generator shown in FIG. 3.

Referring to FIG. 5, a circuit diagram is provided for illustrating the reference voltage generator 304 according to a preferred embodiment of the present invention. The reference voltage generator 304 includes a reference voltage bias part 501 and a reference voltage coding part 502. The reference voltage bias part 501 includes a first transistor 510 that is connected to an output node of the reference voltage generator 304 generating an internal reference voltage Vref in and a power source voltage VDDQ, and a second transistor 512 that is connected to the output node generating the internal reference voltage Vref in and a ground voltage VSSQ. The first and second transistors 510, 512 are preferably diode type transistors. The reference voltage bias part 501 automatically sets a predetermined voltage as an initial internal reference voltage Vref_in when the power source voltage VDDQ is provided to the reference voltage bias part 501.

The reference voltage coding part 502 includes, for example, seven voltage programming parts 520, 530, . . . , 580 receiving the first to seventh thermometer codes U[6:0], D[6:0], respectively. The first voltage programming part 520 includes a voltage-up controller 521 and a voltage-down controller 522 receiving the first thermometer code U<0>, D<0>. The voltage-up controller 521 includes inverter type first and second transistors 523, 524 that are connected between the power source voltage VDDQ and the internal reference voltage Vref_in and controlled by the first thermometer code U<0>. The U<0:6> and D<0:6> output from code generations 401 to 407 are input to respective voltage up and down controllers as shown FIG. 5. The voltage-up controller 521 also includes a third transistor 525 for increasing the internal reference voltage Vref_in in response to an output signal from the first and second transistors 523, 524. If the transistor 525 is turned-off, the number of transistors connected to the power source voltage VDDQ, including the transistor 510, is 7 and the number of transistors connected to the ground voltage VSSQ is 8. Initially, since each of the transistors connected to VDDQ and VSSQ is 8, Vref-int is VDDQ/2. However, when the transistor 525 is turned off, the number of transistors connected to VDDQ and VSSQ are 7 and 8, respectively, and thereby increasing the internal reference voltage Vref. Such control is performed by outputs U<0>through U<6> and D<0>through D<6>from the code generators 401 to 407 in FIG. 4.

The voltage-down controller 522 includes inverter type fourth and fifth transistors 526, 527 receiving the first thermometer code D<0> and a sixth transistor 528 for decreasing the internal reference voltage Vref_in in response to an output signal from the fourth and fifth transistors 526, 527.

The second to seventh voltage programming parts 530, 540, . . . , 580 receive the second to seventh thermometer codes U<1>, D<1> to U<6>, D<6>, respectively. The second to seventh voltage programming parts 530, 540, . . . , 580 selectively increase or decrease the internal reference voltage Vref_in in response to the second to seventh thermometer codes U<1>, D<1> to U<6>, D<6>, respectively. The second to seventh voltage programming parts 530–580 each have the substantially same configuration and operation as those of the first voltage programming part 520. Thus, a detailed description of the second to seventh voltage programming parts 530–580 is omitted.

Figure 6:
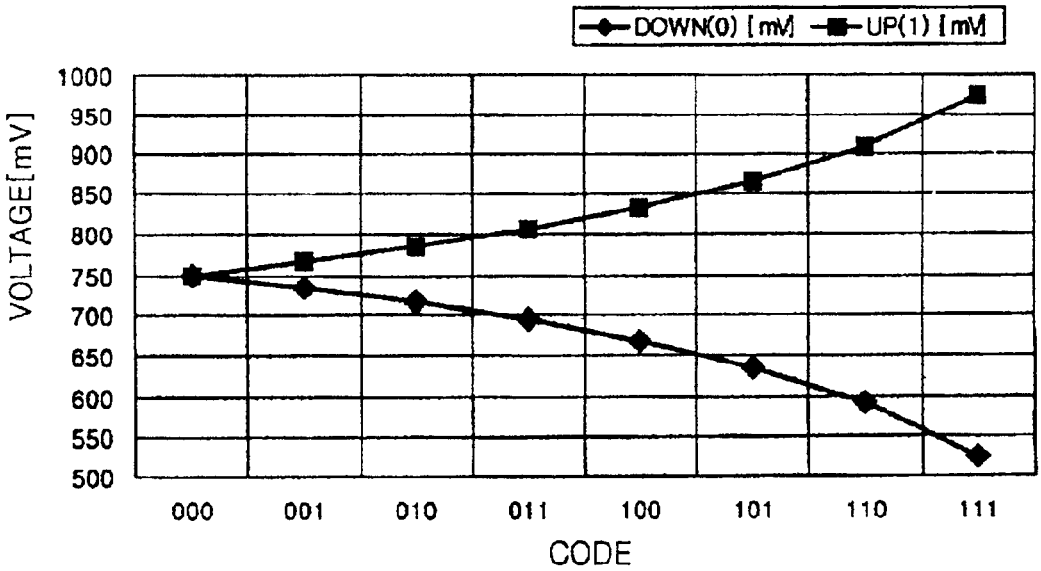
FIG. 6 is a graphical view of the internal reference voltage generated from the internal reference voltage generator in FIG. 5.

FIG. 6 is a graphical view of the internal reference voltage generated from the internal reference voltage generator in FIG. 5. The internal reference voltage in FIG. 6 is obtained as an experimental result of simulation of the reference voltage generating circuit according to the present invention. As shown in FIG. 6, the internal reference voltage Vref_in generated from the internal reference voltage generator increases or decreases in response to the binary codes CODE.

Figure 7:
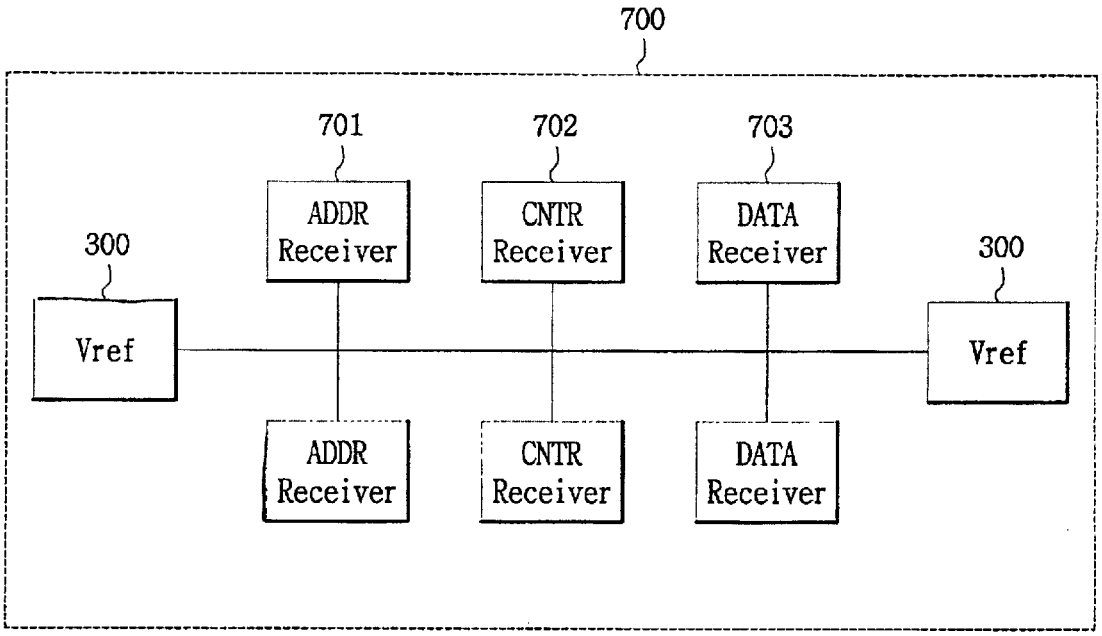
FIG. 7 is a block diagram for illustrating a method of arranging reference voltage generating circuits according to an embodiment of the present invention.

FIG. 7 is a block diagram for illustrating arrangement of reference voltage generating circuits in a chip according to a preferred embodiment of the present invention. As shown in FIG. 7, for example, two reference voltage generating circuits 300 are disposed at the end sides of a chip 700 in which devices 701–703 are connected in common with the reference voltage generating circuits 300. The devices in the chip 700 may be receivers, such as an address receiver 701, control signal receiver 702 and data receiver 703, which share a reference voltage provided from the reference voltage generating circuits 300. Such arrangement of the reference voltage generating circuits 300 and the receivers 701, 702, 703 serves to effectively reduce the chip size, when compared with the case where each of the receivers is connected with a separate reference voltage generating circuit. In addition, probability of occurrence of errors due to a mismatch between the reference voltage generating circuits can be reduced by arranging the reference voltage generating circuits 300 as shown in FIG. 7.

Having described the preferred embodiments of the invention with reference to the accompanying drawings, it is understood that the invention is not limited to those precise embodiments, and various changes and modifications may be effected therein by one skilled in the art without departing from the scope and sprit of the invention as defined in the appended claims.

What is claimed is:

1. An internal reference voltage generating circuit comprising:

a reference voltage bias part connected between a power source voltage node and a ground voltage node, for establishing an initial value of an internal reference voltage on an internal reference voltage node when a power source voltage is applied to the power source voltage node;

a reference voltage coding part connected to the reference voltage bias part, for increasing or decreasing the internal reference voltage in response to thermometer codes obtained from programmable binary codes;

voltage-up controllers connected between the power source voltage node and the internal reference voltage node, or increasing the internal reference voltage in response to the thermometer codes;

voltage-down controllers connected between the internal reference voltage node and the ground voltage node, for decreasing the reference voltage in response to the thermometer codes;

wherein the voltage-up controllers each comprise:

an inverter connected between the power source voltage node and the internal reference voltage node and controlled by the thermometer codes; and a transistor connected between the power source voltage node and the internal reference voltage node, for increasing the internal reference voltage in response to outputs of the inverter.

2. The circuit as claimed in claim 1, wherein the voltage-down controllers each comprise:

an inverter connected between a power source voltage and the ground voltage node and controlled by the thermometer codes; and a transistor connected between the internal reference voltage node and the ground voltage node, for decreasing the internal reference voltage in response to outputs of the inverter.

3. A reference voltage generating circuit comprising:

a binary-to-thermometer for converting binary codes into thermometer codes, wherein the binary-to-thermometer comprises thermometer code generators for generating the thermometer codes in response to the binary codes, wherein the thermometer code generators each include: a logic gate for selectively receiving the binary codes; transmission gates for transmitting an output of the logic gate to generate a thermometer code in response to a selected signal of the binary codes; and transistors for resetting the thermometer code in response to the selected signal of the binary codes;

an internal reference voltage generator for generating an internal reference voltage in response to the thermometer codes from the binary-to-thermometer, wherein the internal reference voltage generator changes a level of the internal reference voltage in response to the thermometer codes;

a selector for selecting the internal reference voltage or an external reference voltage in response to a reference voltage select signal; and a voltage regulator for regulating a reference voltage selected by the selector.

4. A reference voltage generating circuit comprising:

a binary-to-thermometer for converting binary codes into thermometer codes;

an internal reference voltage generator for generating an internal reference voltage on an internal reference voltage node in response to the thermometer codes from the binary-to-thermometer, wherein the internal reference voltage generator charges a level of the internal reference voltage in response to the thermometer codes; and a selector for selecting the internal reference voltage or an external reference voltage in response to a reference voltage select signal, wherein the internal reference voltage generator comprises:

a reference voltage bias part having a diode type first transistor connected between a power source voltage node and the internal reference voltage node and a diode type second transistor connected between the internal reference voltage node and a ground voltage node;

a reference voltage coding part for increasing or decreasing the internal reference voltage in response to the thermometer codes;

voltage-up controllers connected between the power source voltage node and the internal reference voltage node, for increasing the internal reference voltage in response to the thermometer codes;

voltage-down controllers connected between the internal reference voltage node and the internal reference voltage node, for increasing the internal reference voltage in response to the thermometer codes;

wherein the voltage-up controllers each comprise:

an inverter connected between the power source voltage node and the internal reference voltage node and controlled by the codes; and a transistor connected between the power source voltage node and the internal reference voltage node, for increasing the internal reference voltage in response to outputs of the inverter.

5. The circuit as claimed in claim 4, wherein the voltage-down controllers each comprise:

an inverter connected between a power source voltage and the ground voltage node and controlled by the thermometer codes; and a transistor connected between the internal reference voltage node and the ground voltage node, for decreasing the internal reference voltage in response to outputs of the inverter.

* * * * *